US006348899B1

(12) United States Patent
Bergstein

(10) Patent No.: US 6,348,899 B1
(45) Date of Patent: Feb. 19, 2002

(54) ANTENNA MAST ADAPTER

(76) Inventor: David M. Bergstein, P.O. Box 1111, Chino Valley, AZ (US) 86323

( * ) Notice: Subject to any disclaimer, the term of this patent is extended or adjusted under 35 U.S.C. 154(b) by 0 days.

(21) Appl. No.: 09/577,333

(22) Filed: May 24, 2000

(51) Int. Cl.[7] ..... H01Q 1/12
(52) U.S. Cl. ..... 343/890; 343/878
(58) Field of Search ..... 343/795, 878, 343/880, 881, 882, 893, 874, 815

(56) References Cited

U.S. PATENT DOCUMENTS

| | | | | |
|---|---|---|---|---|
| 2,299,218 A | | 10/1942 | Fener | |
| 2,337,710 A | | 12/1943 | Cowan | |
| 2,445,336 A | | 7/1948 | Rauch | |
| 2,714,161 A | | 7/1955 | Featherstun | |
| 2,967,300 A | * | 1/1961 | Haughawout | 343/815 |
| 3,017,632 A | | 1/1962 | Bernard | |
| 3,560,987 A | | 2/1971 | Lockwood | |
| 3,683,392 A | * | 8/1972 | White | 343/805 |
| 4,005,432 A | | 1/1977 | Beccario | 343/792.5 |
| 4,066,324 A | | 1/1978 | Stephens | 343/906 |
| 4,207,574 A | * | 6/1980 | Toia | 343/752 |
| 4,355,315 A | | 10/1982 | Zoulek | 343/792.5 |
| 4,543,584 A | | 9/1985 | Leer | 343/881 |
| 5,144,326 A | | 9/1992 | Christinsin | 343/715 |
| 5,221,929 A | | 6/1993 | Ott | 343/715 |
| 5,252,985 A | | 10/1993 | Christinsin | 343/880 |
| 5,285,212 A | * | 2/1994 | McNiece | 343/795 |
| 5,364,049 A | | 11/1994 | Long | 248/205.1 |
| 5,533,304 A | * | 7/1996 | Noble | 343/880 |

* cited by examiner

*Primary Examiner*—Tan Ho
(74) *Attorney, Agent, or Firm*—Davidson & Gribbell, LLP

(57) ABSTRACT

An antenna mast adapter is provided capable of holding several different antennas in place that mounts onto a vertical antenna mast. A crossarm that runs perpendicular to the mast is a main member of the antenna mast adapter and provides at least two mounting plates to which individual antennas are mounted, either using mechanical mounting means or magnetic mounting means. The crossarm is generally designed to provide these mounting plates at the extreme ends of the crossarm, thereby providing an air gap between the antennas and the mast. The crossarm can be constructed from different shaped materials, and in one preferred embodiment, the crossarm includes openings to reduce the wind resistance of the crossarm. The antenna mast adapter provides mounting points for several different antennas, each of which is connected to an individual radio via a waveguide. In such general applications, each antenna receives and/or transmits at a different frequency band than the other antennas mounted to the same antenna mast adapter. In some more specialized applications, a pair of similar antennas are mounted proximal to one another and their individual waveguides connected to a Y-adapter to combine their two waveguides into a single waveguide that is connected to a single radio device. In such specialized applications, each antenna of the pair (of antennas) receives and/or transmits at the same frequency band, although at a different frequency band as compared to other antennas mounted to the same antenna mast adapter.

20 Claims, 14 Drawing Sheets

ANTENNA MAST ADAPTER

TECHNICAL FIELD

The present invention relates generally to radio antenna equipment and is particularly directed to an antenna mounting device of the type which provides multiple mounting points for multiple individual antennas. The invention is specifically disclosed as an antenna mast adapter that provides an elongated crossarm that mounts to a standard mast, in which the crossarm exhibits mounting plates at its two opposite ends that are distal from the mast, and each mounting plate is capable of holding at least one individual antenna thereto.

BACKGROUND OF THE INVENTION

Antenna mounting structures have been available for decades, including those that have multiple horizontal elements such as dipole elements mounted to a transverse horizontal boom, all as a unitary antenna structure. An example of this antenna structure is disclosed in U.S. Pat. No. 2,299,218 (by Fener), which discloses an adjustable dipole antenna unit that is mounted on a vertical pole. A transverse arm is mounted to the top of the vertical pole. Each end of the transverse arm has a dipole unit attached thereto, in which there are a pair of rods mounted horizontally, extending perpendicularly from each end of the transverse arm.

A similar structure is illustrated in U.S. Pat. No. 4,355,315 (by Zoulek), which discloses a log periodic directional antenna that provides a signal gain in one direction over a wide range of frequencies. The antenna mount is positioned vertically and supports a horizontal boom at its mid-point. The boom comprises two channel elements, that are disposed about a wooden core. A plurality of "log periodic elements" make up the actual antenna elements, which are disposed from a shorter length at one end of the boom progressively to a longer length at the opposite end of the boom. These antenna elements are disposed on both sides of the boom. In one embodiment, the antenna elements are arranged horizontally extending from the boom, which provides for a horizontal polarization. In a second embodiment, the elements are disposed vertically, on both the top and the bottom of the boom, which provides for vertical polarization.

U.S. Pat. No. 4,005,432 (by Beccario) discloses a "commutated log periodic antenna array" used for automatic direction finding. This antenna array uses a vertical support mast and a base plate that supports eight individual horizontal members that extend from the center of the base plate at 45 degree angles from one another. Each of these eight extending horizontal members has attached a plurality of "log periodic antennas" that extend vertically above and below each of the members. These antenna elements are of varying length, from the shortest element at the furthest point from the center of the support mast to the longest element that is closest to the center of the support mast.

U.S. Pat. No. 2,445,336 (by Rauch) discloses an antenna mounting apparatus that holds six "radiators" (which are antenna elements). A vertical mast holds a base plate, and this base plate provides support for a tapered head that provides three radiator sockets. The sockets hold "fed radiators," which extend upward at an angle that is about 30 degrees from vertical. The base plate also provides three receptacles that contain radiator sockets for three "grounded radiators" that extend downward at an angle about 30 degrees from vertical.

U.S. Pat. No. 3,560,987 (by Lockwood) discloses a support boom to which a planar antenna array is attached. A vertical mast at its top supports a horizontal frame. The horizontal frame then supports a longer horizontal main boom, which extends in parallel to the support frame, but extends at a longer horizontal distance. Multiple conventional antenna field elements are mounted to the main boom in a horizontal direction, much as would be seen with any outdoor T.V. antenna.

A patent disclosing mounting of whip antennas is U.S. Pat. No. 5,252,985 (by Christinsin), which discloses a whip-tilt adapter that allows a whip antenna to be mounted either vertically or near-horizontally. The adapter comprises a pivotable vertical pipe that has a vertical mounting point at the top of the vertical pipe. In addition, there is at least one near-horizontal pipe that joins with the vertical pipe. The near-horizontal pipe has a mounting port to which the whip antenna can be attached to position the whip antenna in a near-horizontal attitude. A second whip antenna can also be mounted to a second near-horizontal member, or it could instead be mounted to the top of the vertical shaft (i.e., in a vertical orientation).

U.S. Pat. No. 5,221,929 (by Ott) discloses an auxiliary antenna assembly that can be used for magnetically-attached antennas, such as those used for citizens band radios on automobiles. The antenna is to be connected to a support platform, and the support platform is hinged to the base unit that contains the magnetic mount. The hinge allows the antenna to yield to an obstruction without dislodging the complete antenna assembly from the vehicle.

None of the above designs provide a means for mounting multiple unitary antennas on a single mounting platform. Instead, each antenna is mounted to its own mast, or other similar mounting platform. It would be an improvement if several unitary antennas could be mounting onto a single mounting platform for ease of installation, especially in situations where different antennas of different frequency band characteristics could be mounting on a single platform.

SUMMARY OF THE INVENTION

Accordingly, it is a primary advantage of the present invention to provide an antenna mast adapter that, as a unitary structure, holds a plurality of individual antennas in place.

It is another advantage of the present invention to provide an antenna mast adapter that uses a crossarm to hold more than one antenna at opposite ends of the crossarm, and holds the individual antennas apart from one another and from the mast to which the antenna mast adapter is mounted.

It is yet another advantage of the present invention to provide an antenna mast adapter in which the crossarm includes mounting plates that each hold one or more individual antennas in place using mechanical and/or magnetic mounting means.

It is a further advantage of the present invention to provide an antenna mast adapter that can mount a pair of similar-type antennas to increase the transmission power or receiver sensitivity, while also holding other pairs or singleton antennas having different frequency band characteristics.

It is still a further advantage of the present invention to provide an antenna mast adapter that runs an individual waveguide for each of a plurality of individual or paired antennas that are mounted onto a crossarm of the antenna mast adapter.

It is yet a further advantage of the present invention to provide an antenna mast adapter in which the crossarm includes openings to reduce wind resistance.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, an improved antenna mounting device is provided in the form of an "antenna mast adapter" which is capable of holding several different antennas in place. In the embodiments illustrated herein, the antenna mast adapter is designed to mount onto a vertical mast, although other orientations could be used without departing from the principles of the present invention. One major element of the antenna mast adapter is a "crossarm" that runs generally perpendicular to the mast. This crossarm provides at least two "mounting plates" to which individual antennas are mounted, either using mechanical mounting means or magnetic mounting means. The crossarm is generally designed to provide these mounting plates at the extreme ends of the crossarm, thereby providing an air gap between the antennas and the mast.

The crossarm can be constructed from different shaped materials, although its general shape consists of an elongated plate material or an L-shaped bracket (or angle bracket) that is held in place against the mast by nuts and bolts, preferably U-shaped bolts. In one preferred embodiment, the crossarm is fabricated from blank sheet material by first punching its outer perimeter, along with any desired openings, and then formed into an angle bracket shape by a press brake. In another preferred embodiment, the crossarm includes openings in the form of through-holes or cut-outs in the main elongated plate material, in which these openings reduce the wind resistance of the crossarm. This can aid in allowing the antenna mast adapter to be used in high winds, either on a stationary structure, or on a mobile device, such as a land vehicle.

In general, the antenna mast adapter provides mounting points for several different antennas, each of which is connected to an individual radio via a waveguide, such as a standard antenna cable. In such general applications, each antenna receives and/or transmits at a different frequency band than the other antennas mounted to the same antenna mast adapter.

In some more specialized applications, a pair of similar antennas could be mounted proximal to one another and their individual waveguides connected to a Y-adapter to combine their two waveguides into a single waveguide that is connected to a single radio device. The pair of similar antennas could be mounted co-linearly in the same vertical line, in which the top antenna mounts pointing in one direction, and the bottom antenna mounts pointing in the opposite direction. In such specialized applications, each antenna of the pair (of antennas) receives and/or transmits at the same frequency band, although at a different frequency band as compared to other antennas mounted to the same antenna mast adapter.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the descrippion and claims serve to explain the principles of the invention. In the drawings:

Reference will now be made in detail to the present preferred embodiment of the invention, an example of which is illustrated in the accompanying drawings, wherein like numerals indicate the same elements throughout the views.

Referring now to the drawings, FIG. 1 shows an antenna mast adapter device generally designated by the reference numeral 10 constructed in accordance with the present invention. The device 10 includes a horizontal or transverse crossarm 12, which mounts to a center shaft or mast 50. The mast 50 is mounted on a house 60 or other similar building structure, or alternatively could be mounted to a moving vehicle such as an automobile. In FIG. 1, house 60 is depicted as having a roof at 62, and a gable at 64 having a mainly vertical surface.

In FIG. 1, the mast 50 is mounted to the house 60 (or similar structure) by a mounting bracket 8, and nuts 6 and bolts 4, or by any such other conventional fastening means. The crossarm 12 is mounted to the mast by any conventional fastening means, such as nuts 52 and U-bolts 54. Additionally, the crossarm 12 exhibits openings 40 to lessen the wind resistance. In this particular configuration, the openings 40 decrease in size while traversing from the center of the crossarm 12 to each end of the crossarm 12. It will be understood that various sizes and shapes of openings 40 can be used in crossarm 12 without departing from the principles of the present invention. For example, on FIG. 1 openings 40 are generally triangular in shape, whereas on FIG. 4, similar openings 140 are generally trapezoidal in shape; moreover the openings 40 and 140 are of various physical sizes.

An important aspect of the present invention is the fact that crossarm 12 allows for mounting more than one antenna (not shown in FIG. 1) at the extreme ends of the crossarm, and these mountings are referred to herein as antenna mounting areas. Each antenna mounting area has two parallel mounting plates 32, 34 or 22, 24, which are each connected by a vertical rod 30 or 20, respectively, which act as support members between their respective mounting plates.

Figure 12:
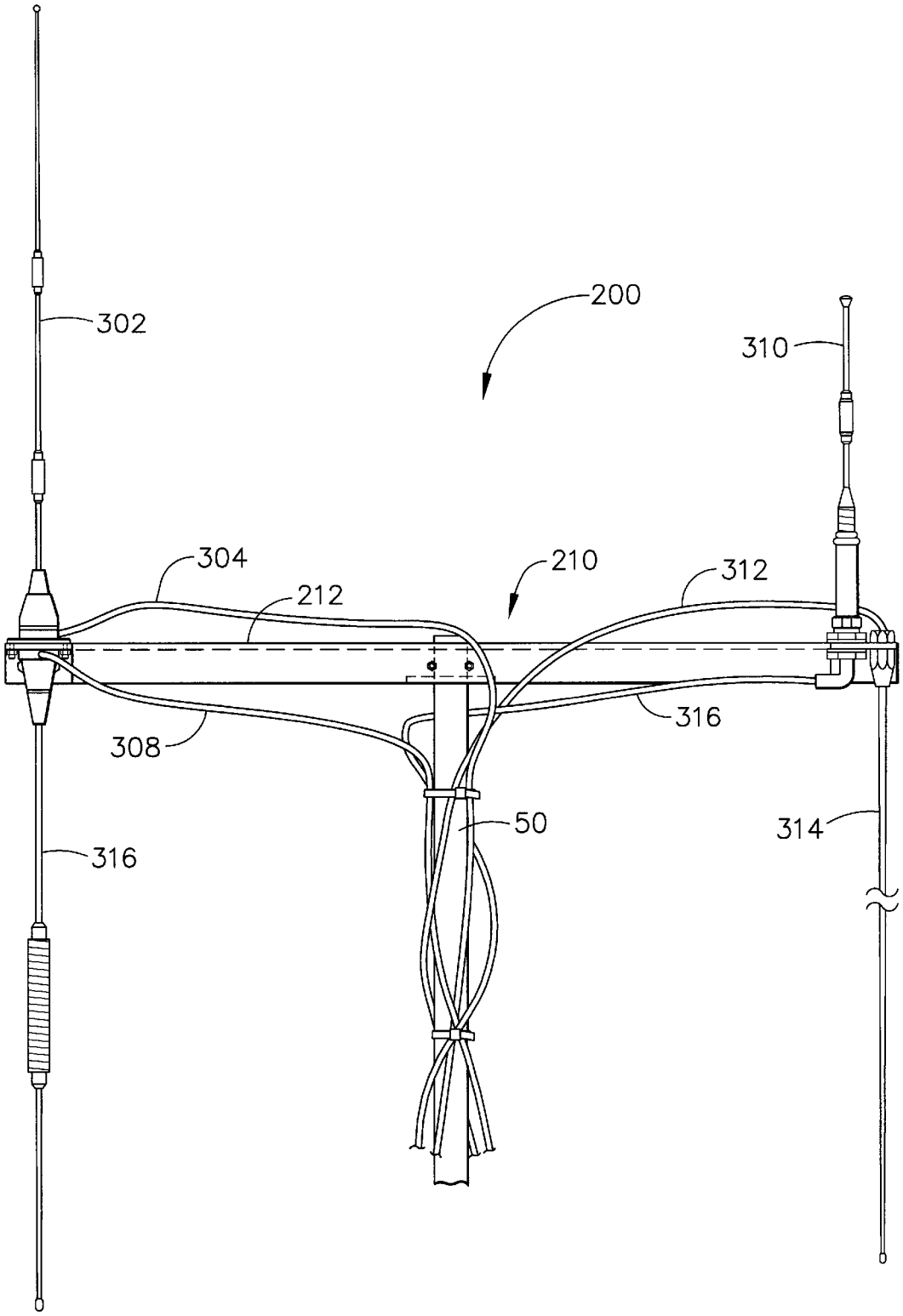
FIG. 12 is a front elevational view of an antenna mast adapter of another alternative construction mounting four different antennas and four separate antenna cables, while using only one antenna mast adapter.
Figure 13:
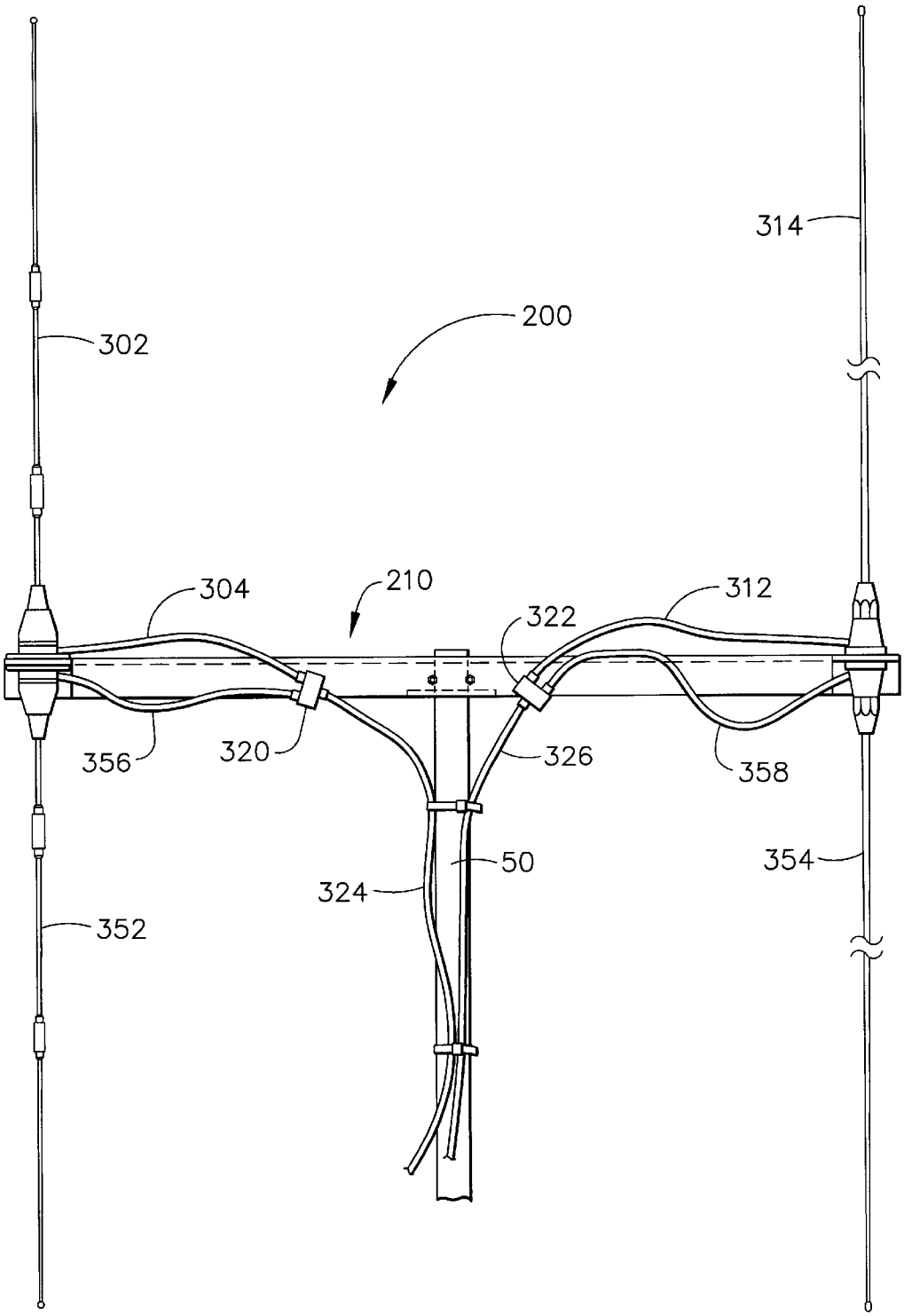
FIG. 13 is a front elevational view of the antenna mast adapter of FIG. 12, mounting four antennas of two different types connected to two separate antenna cables, while using only the single antenna mast adapter.

In FIG. 12 and FIG. 13, it can be seen that similar antenna mast adapters 200 each hold multiple antennas at their mounting areas. In FIG. 12, the crossarm 210 mounts four different antennas 302, 316, 310 and 314, as well as four different associated antenna cables 304, 308, 312 and 316, respectively. In this illustrated embodiment, each of the four antennas 302, 316, 310 and 314 are of different types, and this is the most general arrangement of antennas that are mounted upon the antenna mast adapter 200. It will be understood that any type of radio frequency waveguide could be used as these antenna cables, and that they do not necessarily need to be round in profile.

In FIG. 13, for example, an alternative antenna arrangement is illustrated, in which the crossarm 210 mounts two different types of antennas 302, 352 and 314, 354 as paired groupings. The antennas 302 and 352 are single loading coil antennas, and are to be used with a first radio transmitter/receiver; the antennas 304 and 354 are configured to act as dipole elements, and are to be used with a second radio transmitter/receiver. In this particular configuration, a Y-cable adapter 320 or 322 can be used as a mixer in receiver mode for greater sensitivity, or as a splitter in transmit mode for greater effective power. This is an alternative antenna arrangement that can be easily managed by use of any of the various embodiments disclosed herein of the antenna mast adapter of the present invention.

In FIG. 13, antenna cables 304 and 356 are connected to the same mixer/splitter 320, and their other ends are respectively connected to antennas 302 and 352. A second pair of antenna cables 312 and 358 are connected to the same mixer/splitter 322, and their other ends are respectively connected to antennas 314 and 354. Between the mixer/splitter 320 and its respective radio device (not shown) is a separate antenna cable 324, and between the mixer/splitter 322 and its respective radio device (not shown) is a separate antenna cable 326. It will further be understood that any type of radio frequency waveguide could be used as any of the antenna cables described above, and that there is no requirement that these waveguides be of any particular shape to work well with the present invention.

In both FIGS. 12 and 13, the antenna cables 304, 308, 312, and 316 (in FIG. 12), and antenna cables 324 and 326 (in FIG. 13), are illustrated as travelling along the crossarm 210, and then down either the exterior of mast 50. Alternatively, these antenna cables could be placed within an interior space of a hollow mast 50, if desired, as far a practicable until exiting this interior space to reach their respective radio devices. Most radio antenna masts are constructed of a hollow tubular material, so either method of running the antenna cables would work well in most applications.

Figure 15:
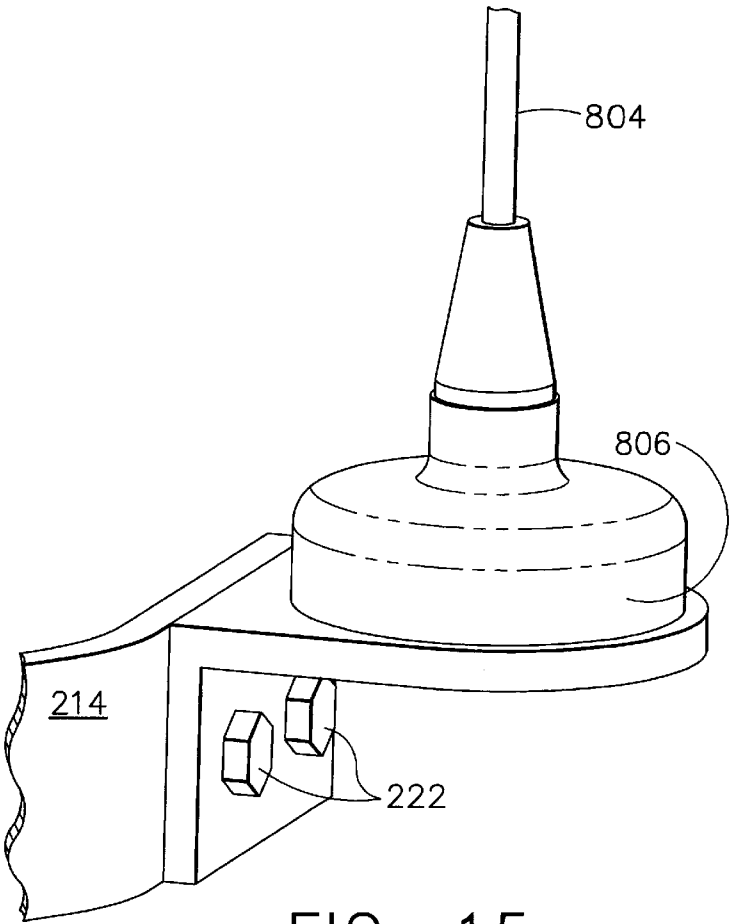
FIG. 15 is a perspective view from above and one side showing an antenna mounting plate using a magnetic mounting means.
Figure 14:
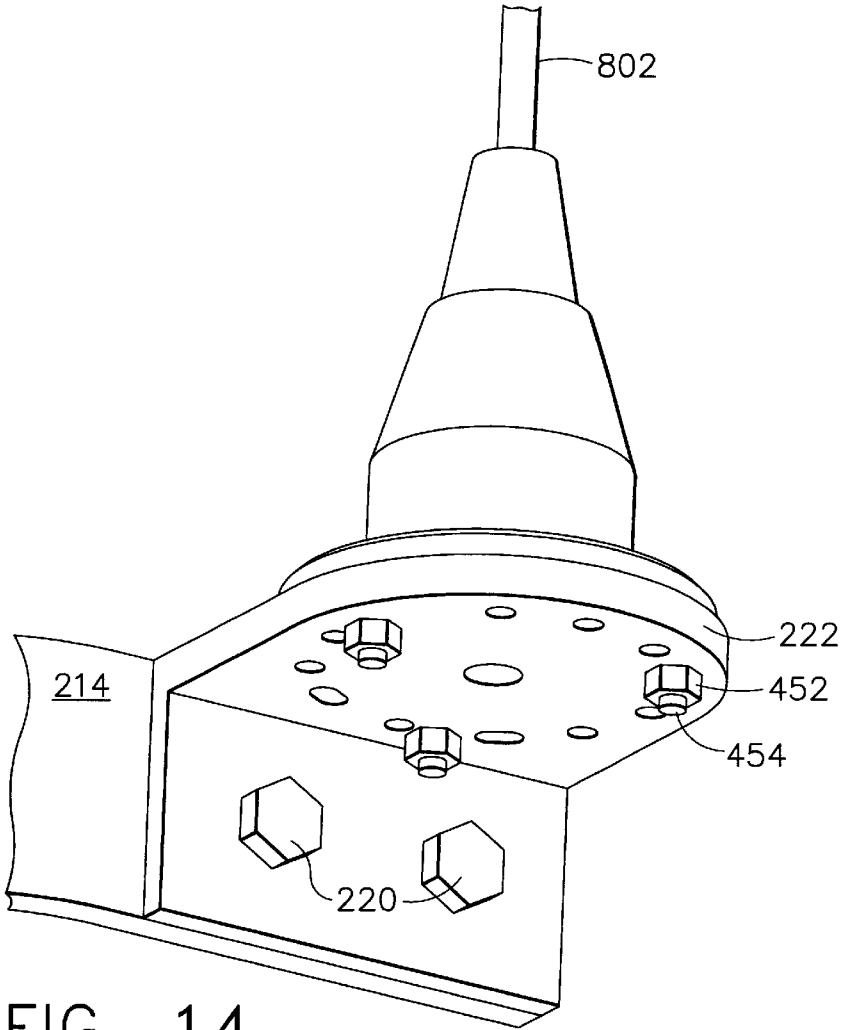
FIG. 14 is a perspective view from below and one side showing an antenna mounting plate using a mechanical mounting means.

Referring back to FIG. 1, the parallel mounting plates 32, 34, 22 and 24 can be made of either magnetic or non-magnetic material as desired to secure an antenna (not shown) to the parallel mounting plates, by magnetic or mechanical means, respectively. For example, FIG. 14 illustrates an antenna 802 mounted to mounting plate 222 by use of a traditional mechanical means, such as nuts 452 and bolts 454. Alternatively, FIG. 15 depicts an antenna 804 mounted to a mounting plate 222 by use of magnetic means, in which mounting plate 222 comprises a magnetic steel material and the antenna base at 806 includes a permanent magnet.

It will be understood that the precise method of attachment between the antennas and the mounting plates is not critical to the present invention, and that a single mounting plate (e.g., plate 222) could be used to mount several different types of antennas without departing from the principles of the present invention. Certainly, different mounting holes, either threaded or merely through-holes, could be easily provided in the mounting plates for specific models of mechanically-mounted antennas.

Figure 1:
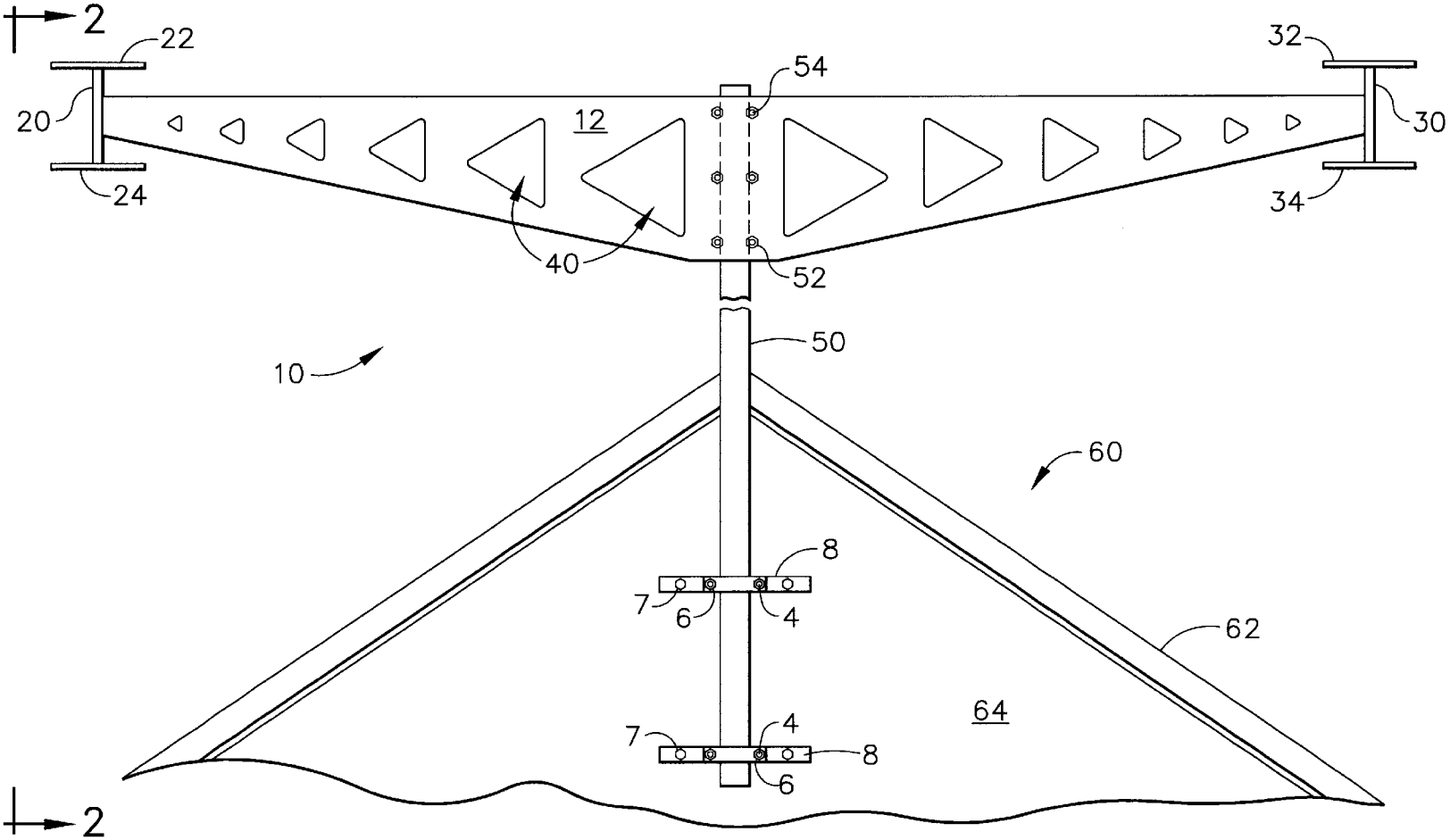
FIG. 1 is a front elevational view of an antenna mast adapter constructed according to the principles of the present invention.
Figure 2:
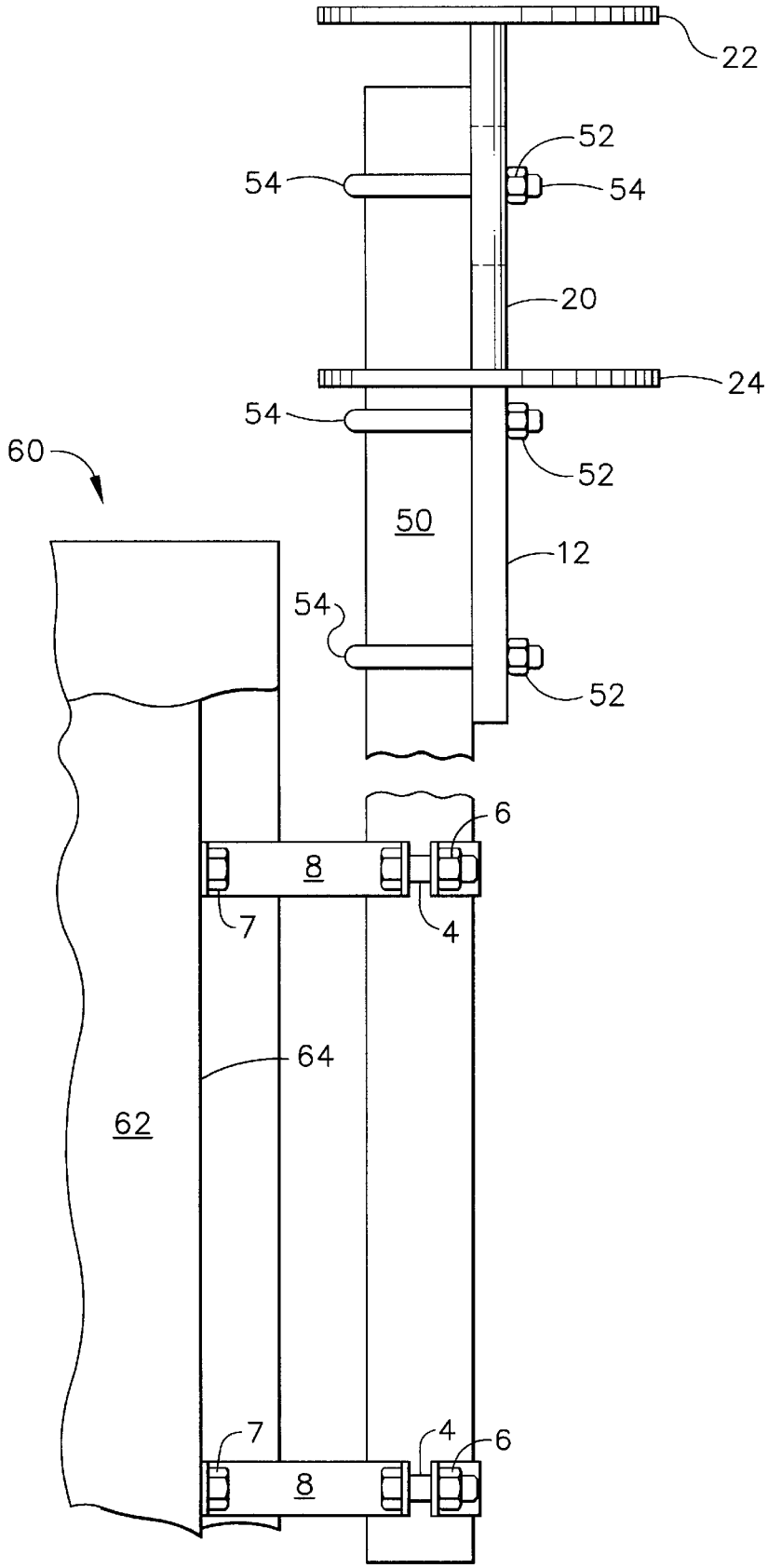
FIG. 2 is a side elevational view of the antenna mast adapter of FIG. 1, from the left side as viewed in FIG. 1.

Referring now to FIG. 2, a detailed side view of the antenna mast adapter 10, is depicted having the same general features as illustrated in FIG. 1. This side view illustrates the fastening of the crossarm 12 to the mast 50 by use of U-bolts 54 and nuts 52, and further illustrates the side view shows in detail the fastening of the mast 50 to the house 60 by use of mounting bracket 8, and nuts 6 and bolts 4.

Figure 3:
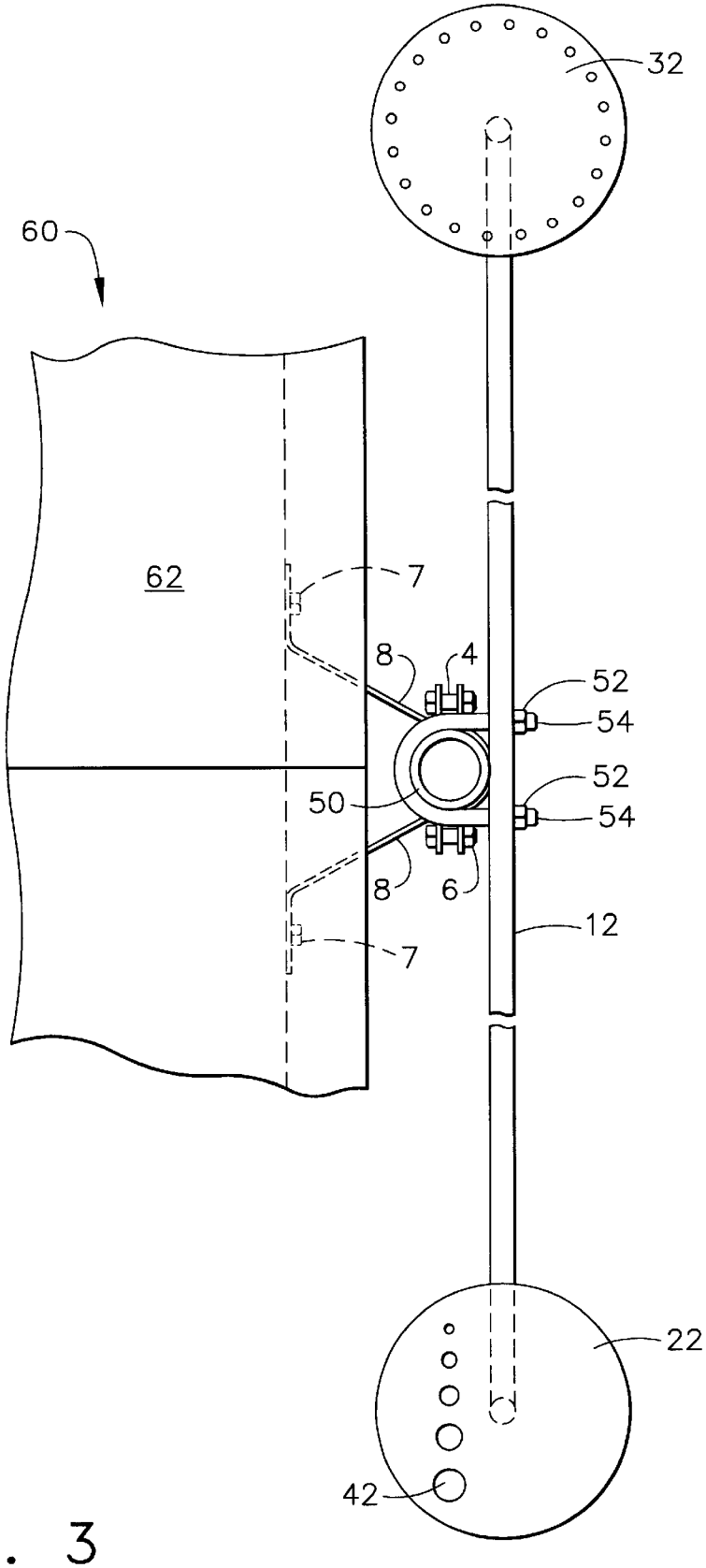
FIG. 3 is a top plan view of the antenna mast adapter of FIG. 1 showing different bolt hole configurations of the mounting plates.

FIG. 3 is a top plan view of the antenna mast adapter, which illustrates the physical planer shape of the parallel mounting plates 22 and 32. The shape of the parallel mounting plates 22, 32 can be changed according to the shape of the particular type of antenna to be mounted thereto, without departing from the principles of the present invention. Likewise, the arrangement of bolt holes 42 on the parallel mounting plates 22, 32 can vary according to the type of antenna being mounted on the parallel mounting plate 22, 32, again without departing from the principles of the present invention. Also in this view, the structure of the mounting bracket 8, nuts 6 and bolts 4, which fasten the mast 50 to the house 60, can be viewed more clearly.

Figure 4:
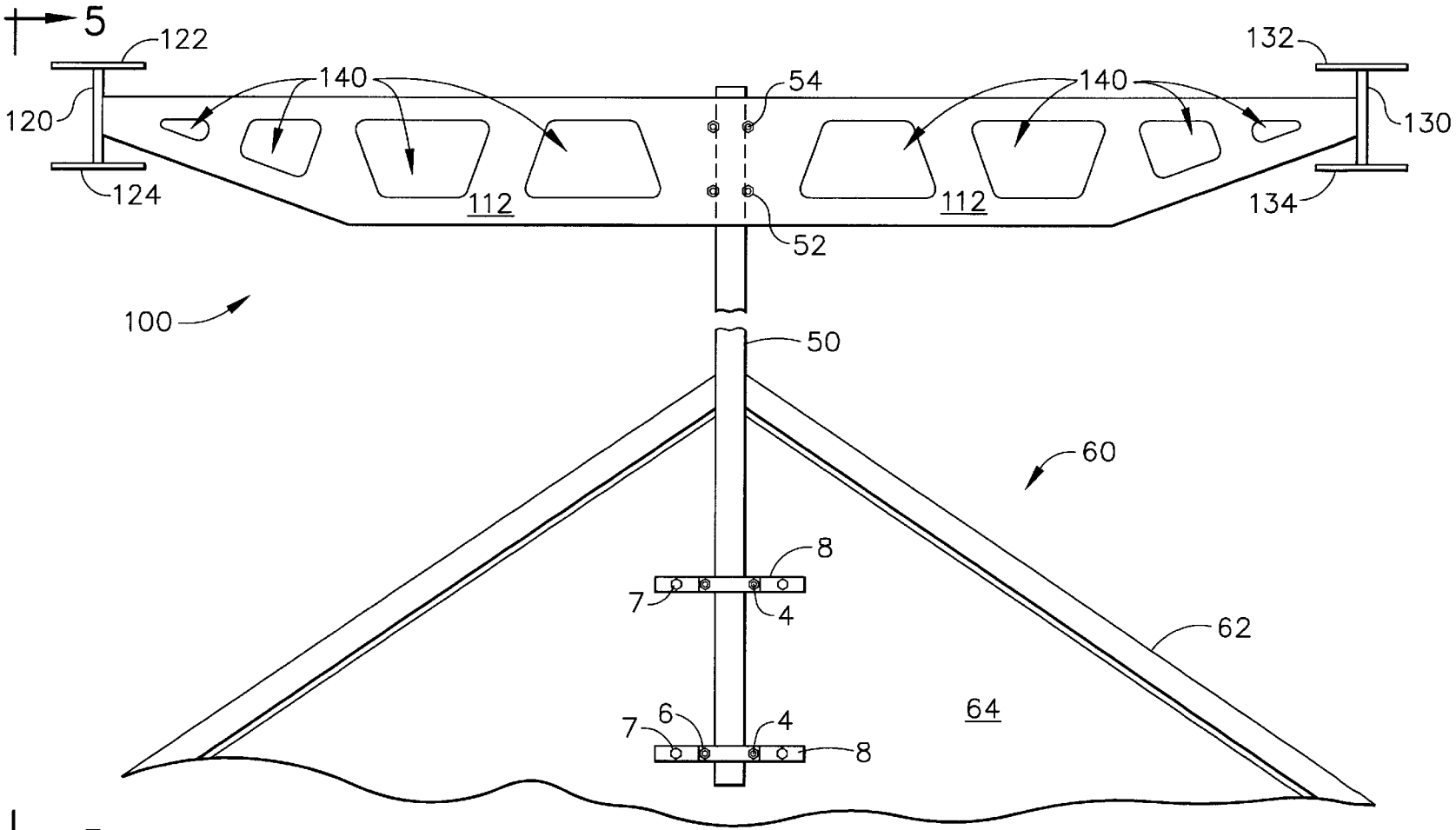
FIG. 4 is a front elevational view of an alternative construction antenna mast adapter showing a crossarm having a different shape and configuration of hole shapes as compared to that of FIG. 1.

FIG. 4 illustrates a second embodiment antenna mast adapter 100 having a different shaped crossarm 112 and different shaped wind resistance-reducing holes 40, as compared to that of FIG. 1. The shape of the crossarm 112 and the wind resistance-reducing holes 140 can vary without departing from the principles of the present invention.

Figure 5:
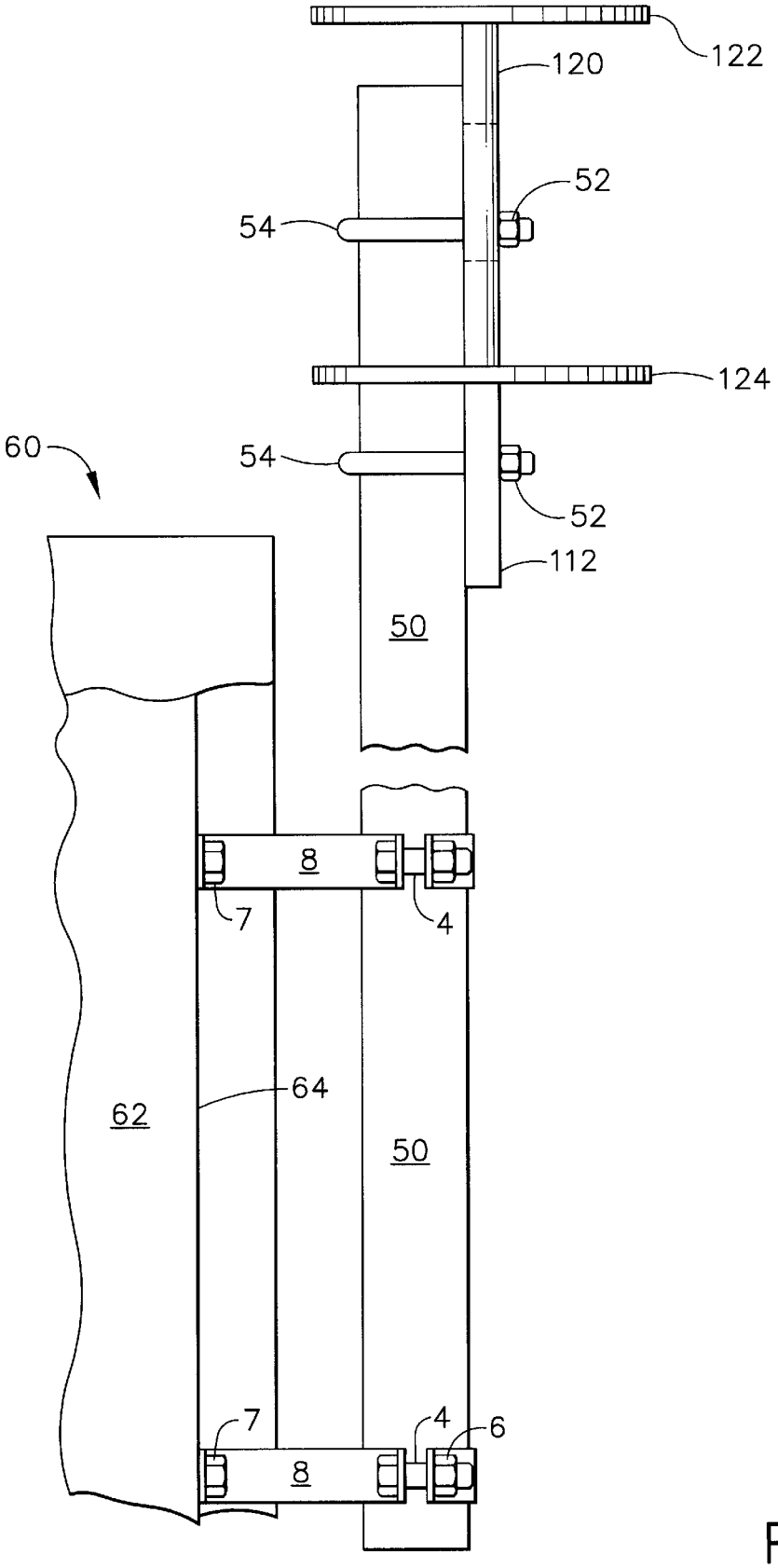
FIG. 5 is side elevational view of the antenna mast adapter of FIG. 4 showing a different mounting configuration as compared to that of FIG. 1.

FIG. 5 shows a modification of the manner in which the crossarm 112 is mounted to the mast 50. FIG. 5 illustrates only two U-bolts 54 along with two nuts 52, instead of three U-bolts 54 and nuts 52 (or similar fastening means), as shown in FIG. 1. This view (similar to that of FIG. 2) shows the structure used to fasten the crossarm 112 to the mast 50, using U-bolts 54 and nuts 52, and also illustrates the bolts 4 and nuts 6 which hold mounting bracket 8 to the house structure. FIG. 5 also illustrates the lower mounting plates 124 and 134, as well as the associated vertical rods 120 and 130.

Figure 6:
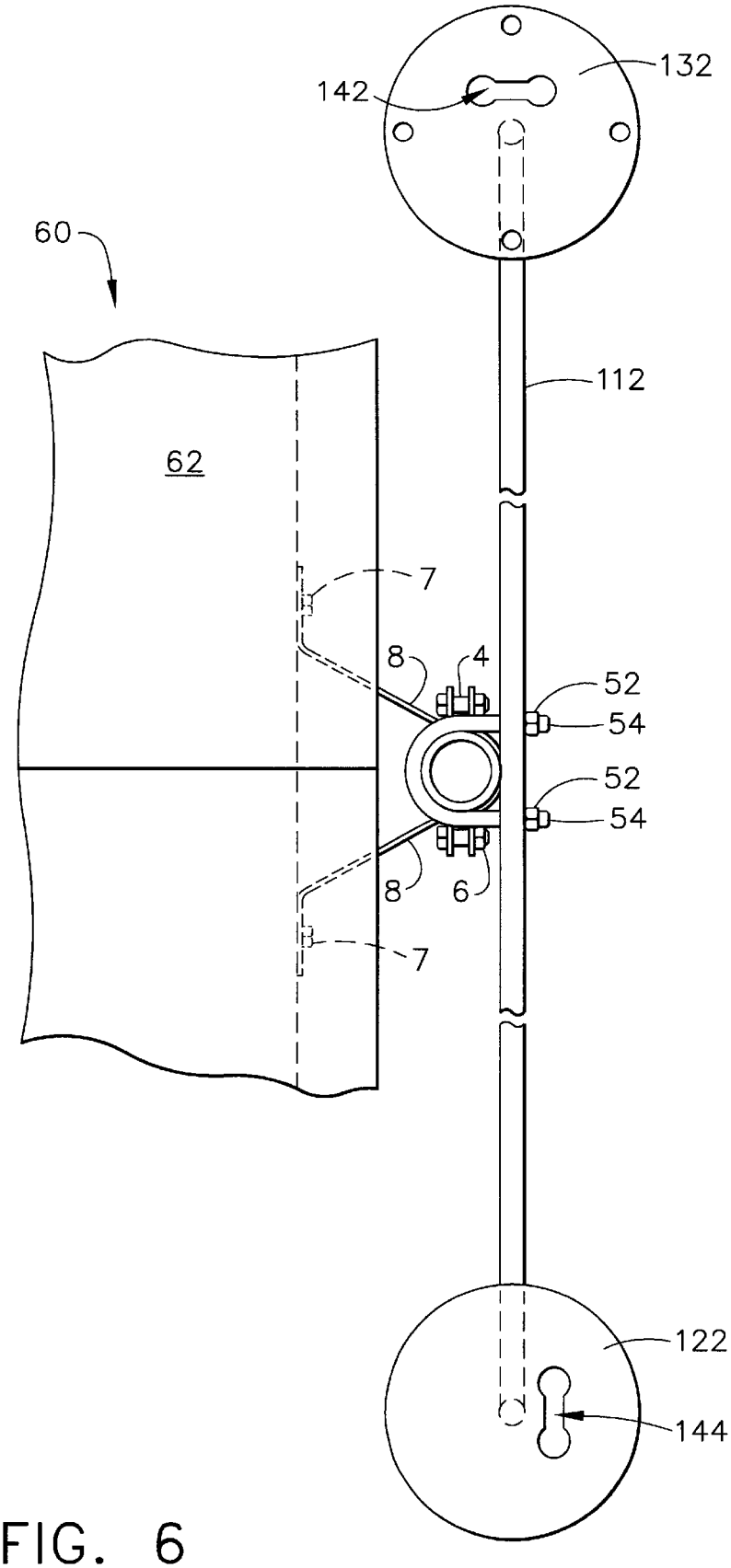
FIG. 6 is top plan view of the antenna mast adapter of FIG. 4 showing yet different bolt holes of the mounting plates.

In FIG. 6, the structure of the mounting bracket 8, nuts 6, and bolts 4, which fasten the mast 50 to the house 60, can be viewed more clearly. Another modification depicted in FIG. 6 shows parallel mounting plates 122 and 132 that exhibit different mounting hole patterns (e.g., mounting holes 142 and 144) as compared to plates 22 and 32 in FIG. 3. Moreover, these mounting plates could be made of a magnetic material (such as a mild steel) so that an antenna may be mounted using magnetic means.

Figure 7:
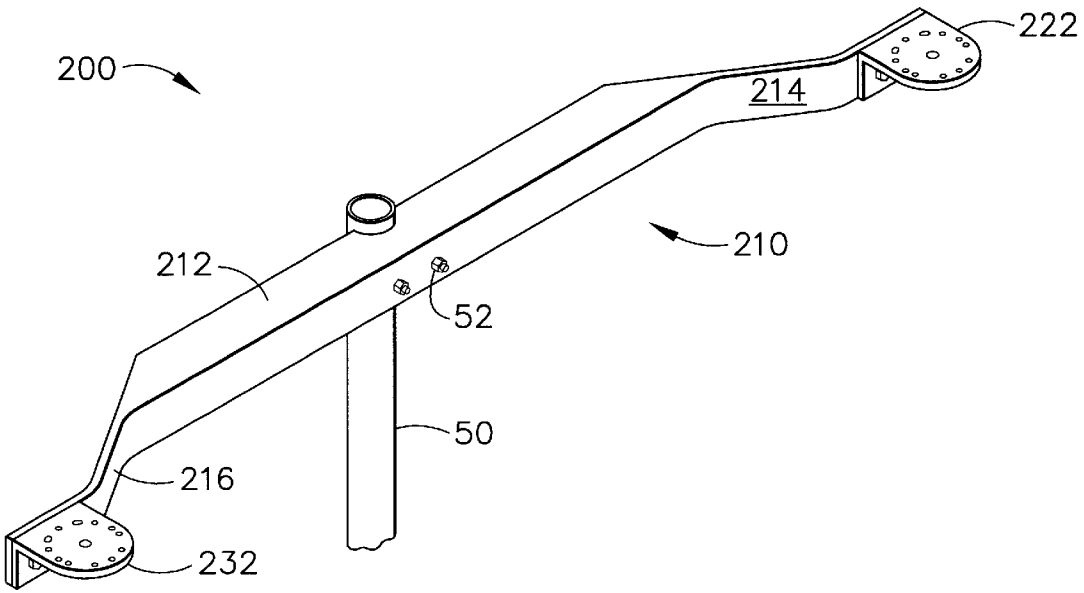
FIG. 7 is a perspective view from above and the front depicting an antenna mast adapter having yet a different crossarm structure as compared to that of FIG. 1.

FIG. 7 illustrates a third embodiment antenna mast adapter 200 having a different shaped crossarm 210, which is constructed of angle bracket material. The crossarm 210 consists of vertical portions (i.e., generally perpendicular to the ground) that are generally depicted at 216 and 214, at each end of the crossarm 210, and a horizontal member (i.e., generally parallel to the ground) 212 between the vertical member portions 216 and 214. This angle-bracket type construction adds structural integrity to the antenna mast adapter 200. There are a pair of mounting plates 232 and 222 attached to the far ends of the vertical member portions 216 and 214 by a fastening means, such as nuts and bolts, which are not illustrated in FIG. 7. These mounting plates 222 and 232 may have a different bolt-hole pattern than those previously described hereinabove, and/or plates 222, 232 could be made of a magnetic material, if desired to mount an antenna having a magnetic mounting base. Furthermore, there could be additional mounting plates (not illustrated in FIG. 7) that are spaced-apart from these mounting plates 222, 232, if desired. It would also be possible to mount an pair of antennas to each of mounting plates 222 and 232, in which a first antenna could mount to the upper surface, and a second antenna could mount to the lower surface.

Figure 8:
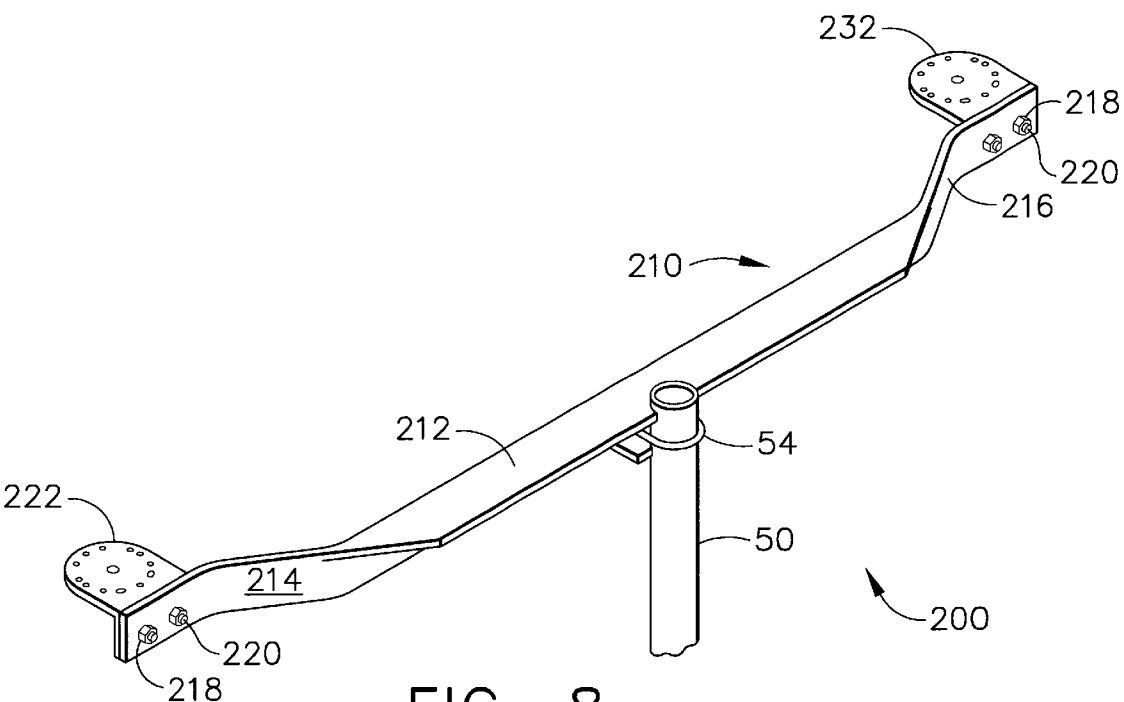
FIG. 8 is a perspective view from above and the rear of the antenna mast adapter of FIG. 7.

FIG. 8 illustrates the same crossarm structure 210 in a view that is rotated 180 degrees from that of FIG. 7. In FIG. 8, nuts 218 and bolts 220, which fasten the mounting plates 232 and 222 to the angle bracket 210, are illustrated. Also, the U-bolt 54 which fastens the angle bracket 210 to the mast 50 can be seen. It will be understood that this particular arrangement of angle-shaped components and mounting plates could be modified without departing from the principles of the present invention.

Figure 9:
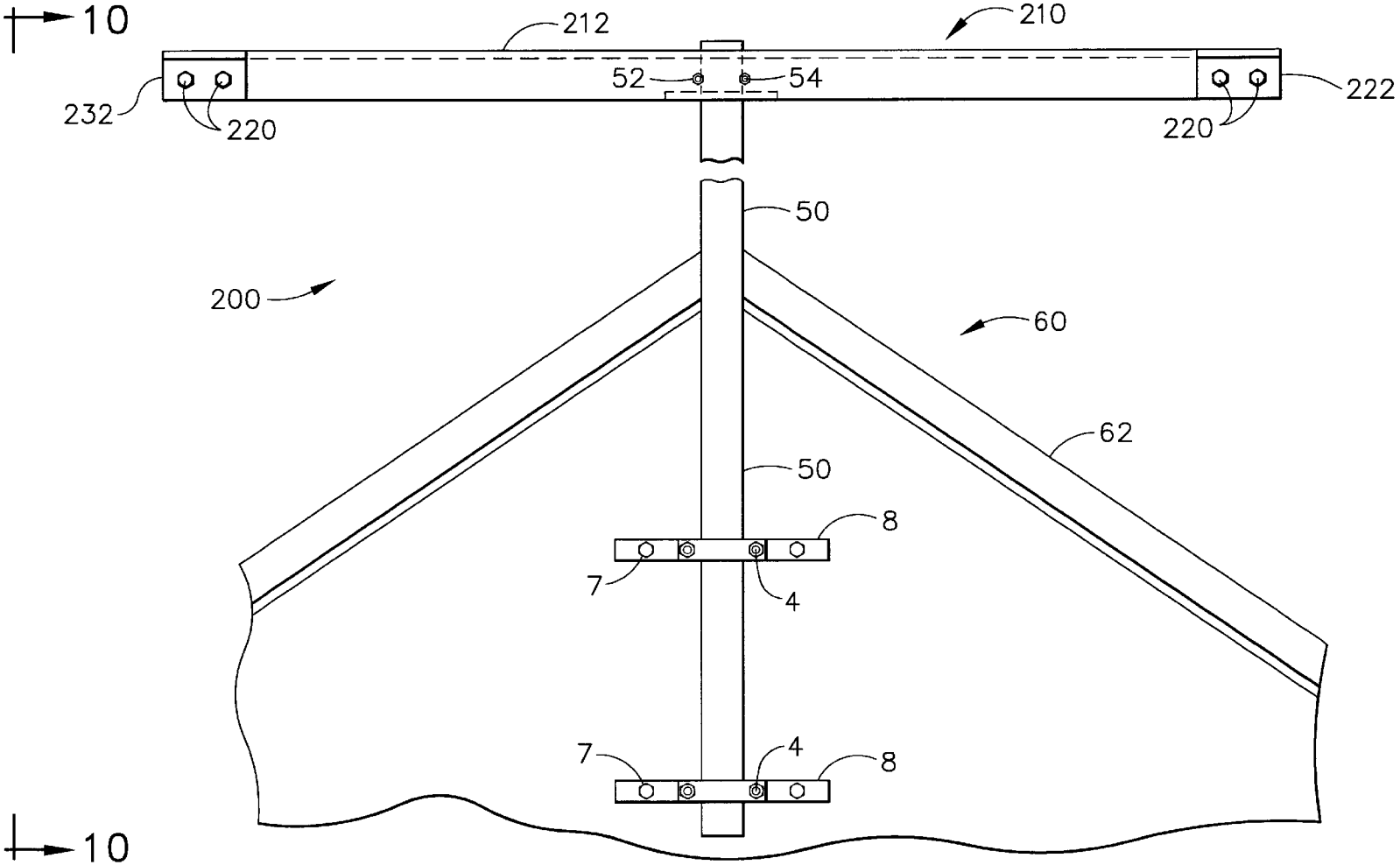
FIG. 9 is a front elevational view of the antenna mast adapter depicted in FIG. 7.

FIG. 9 is a front elevational view of the antenna mast adapter 200 illustrated in FIG. 7, which shows the crossarm 210 fastened to mast 50, which in turn is fastened to house 60 (or other similar structure). In this particular configuration, the crossarm 210 does not exhibit wind resistance-reducing holes, although such wind resistance-reducing holes certainly could be present without departing from the present invention. The mounting hardware can be viewed in FIG. 9, including the bolts 220, and nuts 52 and U-bolts 54, as well as the mounting bracket 8 and associated nuts 6 and bolts 4. In addition, the planar horizontal member 212 is illustrated as running the entire length of the crossarm 210, between the end mounting plates 222 and 232.

Figure 10:
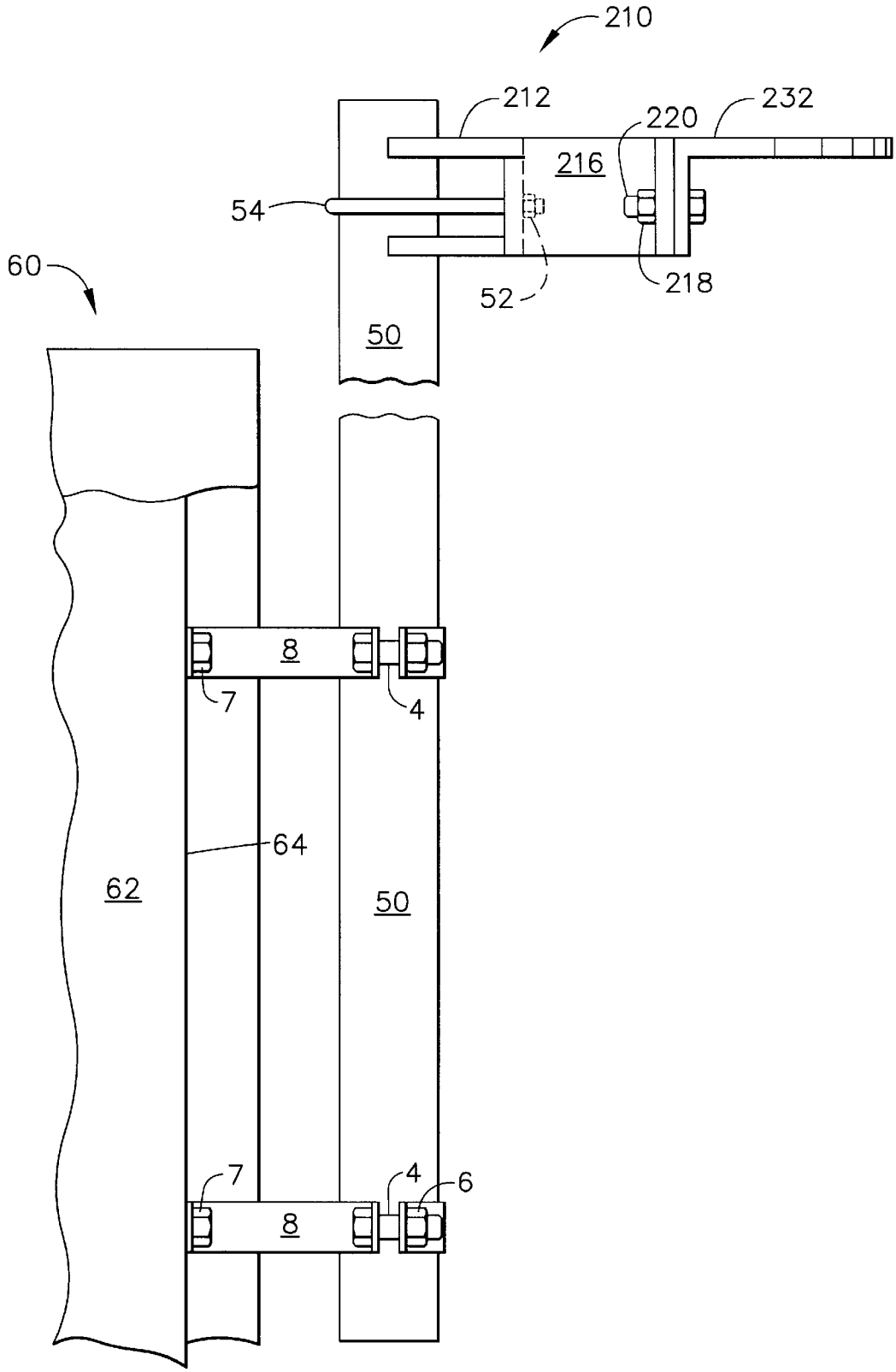
FIG. 10 is a side elevational view of the antenna mast adapter depicted in FIG. 7.

FIG. 10 is a side elevational view of the antenna mast adapter 200 illustrated in FIG. 7, which shows in detail the fastening of the crossarm 210 to the mast 50 by means of a U-bolt 54 and nut 52, and the mounting of the mast 50 to the house 60 by means of mounting bracket 8, and nuts 6 and bolts 4. Also, this view shows in detail the fastening of mounting plate 232 to the vertical member portion 216 of the crossarm 210, by the use bolts 220 (with only one being depicted in this figure) and nuts 218 (with only one being depicted in this figure). It should be noted that the vertical member portion 216 is not strictly planar in this illustrated embodiment, which will be more clear from viewing FIG. 11.

Figure 11:
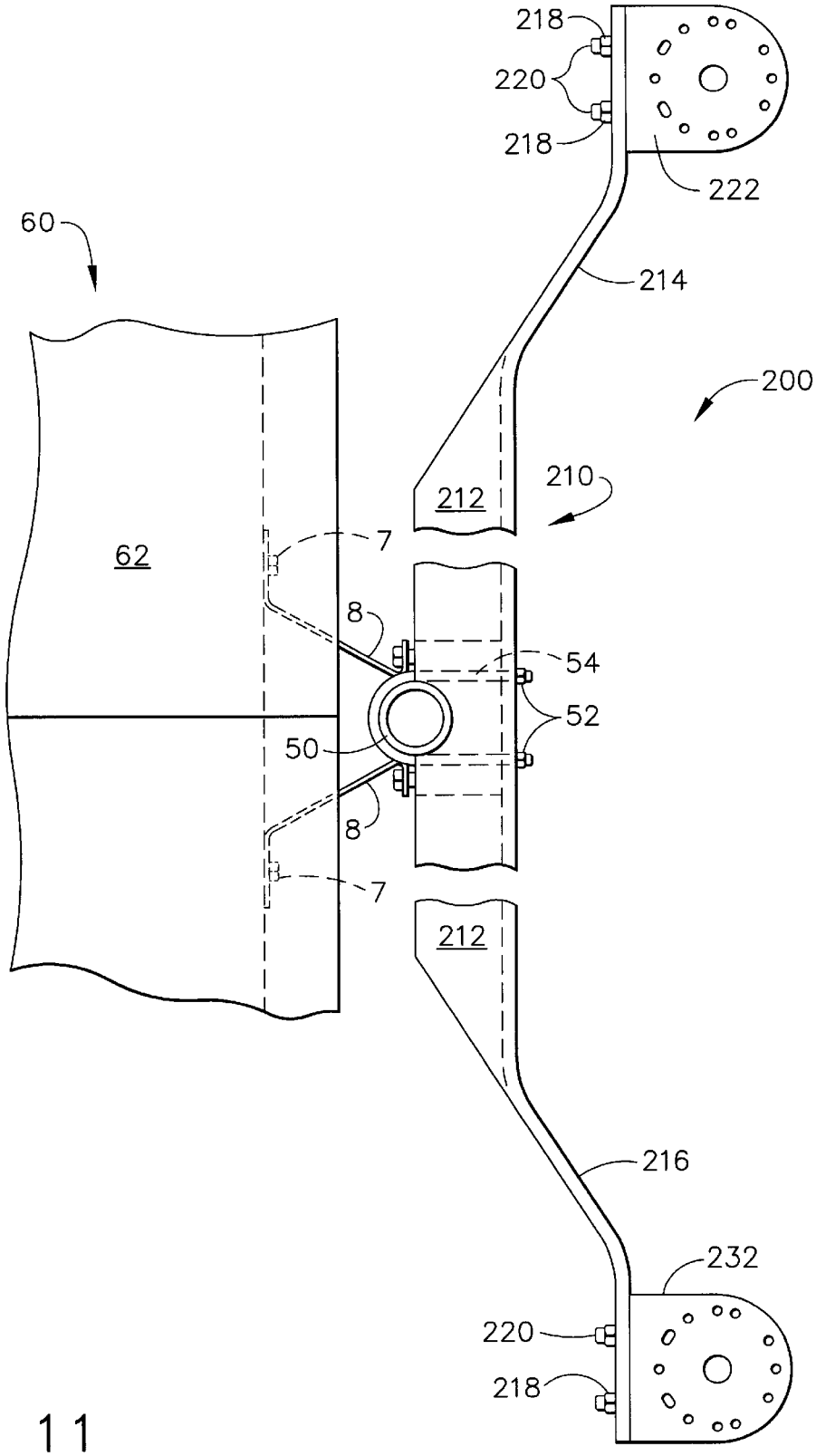
FIG. 11 is a top plan view of the antenna mast adapter depicted in FIG. 7.

FIG. 11 is a top plan view of FIG. 7, which shows in detail the somewhat "S"-bent vertical member portions 214 and 216 of the crossarm 210. Also, the horizontal member 212 of the crossarm 210 can be seen in greater detail. As discussed earlier, this particular physical configuration (horizontal and vertical members of the angle bracket material) adds structural integrity to the antenna mast adapter 200. It will be understood that the crossarm 210 as viewed in FIG. 11 could be made of a single straight angle member without departing from the principles of the present invention. In that arrangement, there would be no "S"-bend in the vertical member portions 214 and 216, and each of these member portions would be planar from one end (at mounting plate 222, for example) to the other end (at mounting plate 232, for example).

Figure 16:
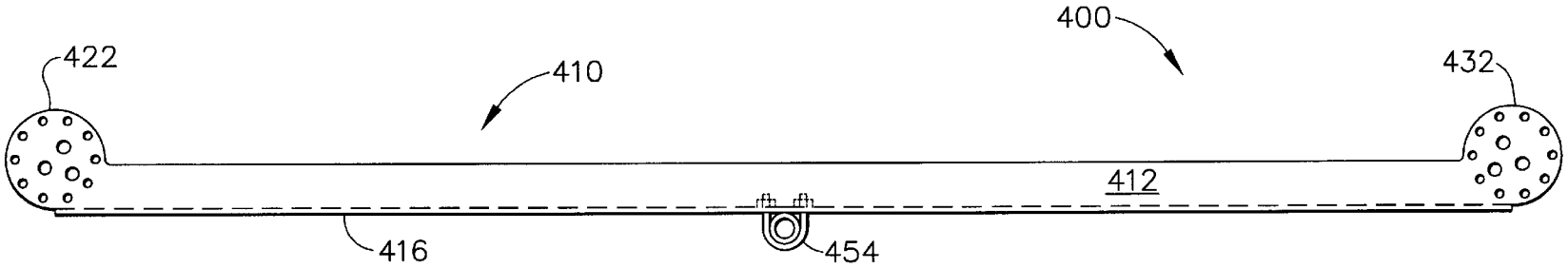
FIG. 16 is a top plan view depicting an antenna mast adapter having yet a further crossarm structure as compared to that of FIG. 1.
Figure 17:
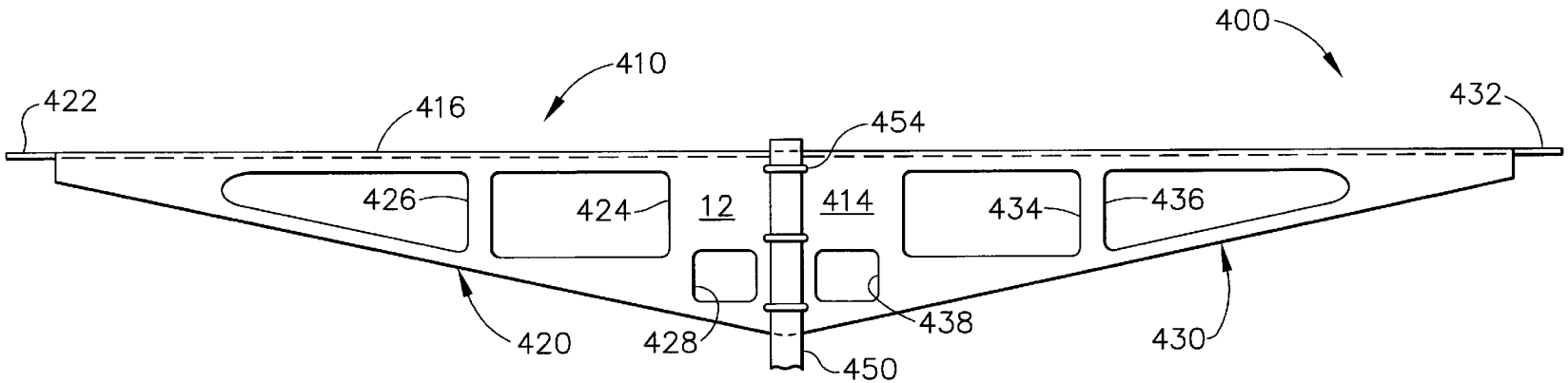
FIG. 17 is a side elevational view of the antenna mast adapter depicted in FIG. 16.

FIGS. 16 and 17 illustrate a fourth embodiment antenna mast adapter 400 having a crossarm 410 of a further different shape, and which again is constructed in the shape of an angle bracket. The crossarm 410 consists of main vertical portion (i.e., generally perpendicular to the ground) that is generally depicted at 414 and a main horizontal portion (i.e., generally parallel to the ground), generally depicted at 412. This angle-bracket type construction adds structural integrity to the antenna mast adapter 400.

Antenna mast adapter 400 includes a left (as viewed in FIG. 17) member 420 and a right (as viewed in FIG. 17) member 430, which make up the main vertical portion 414. Rather than using pre-formed angle bracket material, the crossarm 410 is preferably constructed from blank planar material by use of a bending operation, such as that performed by a press brake. The final shape angled construction results in a substantially 90 degree bend along a line 416, which can be seen on both FIGS. 16 and 17. By use of this fabrication process, all holes can be punched or machined—before the bending procedure—on a flat (i.e., planar) plate that itself can be supplied on a roll of sheet steel, sheet aluminum, or other like material. Of course, the holes can be punched simultaneously as the outer perimeter of the plate is created from the blank material. If desirable, the larger openings can be cut out by a different process other than that which would use a punch press.

It will be understood that the exact fabrication process used, and the exact shape of the final antenna mast adapter, can be significantly altered without departing from the principles of the present invention. For example, the crossarm 410 can be punched (or stamped), cast, molded, or machined, and constructed of metallic or non-metallic materials. One preferred material is ASTM A-94 galvanized sheet steel, having a thickness in the range of 0.125–0.25 inches (3.2 mm–6.3 mm), which would first be punched (stamped), and then bent in a press brake. Any machining that might be required should take place before the press brake operation.

Antenna mast adapter 400 includes a pair of mounting plates 422 and 432 that are formed near the far ends of the left member 420 and right member 430, respectively. As can be seen on FIGS. 16 and 17, the illustrated mounting plates 422 and 432 are formed from the same blank that was punched and braked to form the 90 degree angle shape of the crossarm 410. In this illustrated embodiment, mounting plates 422 and 432 are part of the horizontal structure of the antenna mast adapter 400, i.e., the same portion that includes the main horizontal portion 412. The planar horizontal member 412 is illustrated as running the entire length of the crossarm 410, between the end mounting plates 422 and 432.

Mounting plates 422 and 432 may have a different bolt-hole pattern than those previously described hereinabove, and/or mounting plates 422, 432 could be made of a magnetic material, if desired to mount an antenna having a magnetic mounting base. Furthermore, there could be additional mounting plates (not illustrated in FIG. 16) that are spaced-apart from these mounting plates 422, 432, if desired. It would be possible to mount an pair of antennas to each of mounting plates 422 and 432, in which a first antenna could mount to the upper surface, and a second antenna could mount to the lower surface.

In FIGS. 16 and 17, a set of U-bolts 454 which fasten the crossarm 410 to a mast 450 can be seen. It will be understood that this particular arrangement of angle-shaped components and mounting hardware could be modified without departing from the principles of the present invention.

FIG. 17 is a front elevational view of the antenna mast adapter 400, and in this particular configuration, the crossarm 410 exhibits several wind resistance-reducing openings, such as holes or cut-outs at 424, 426, 428, 434, 436, and 438. The use of such rather large openings serves two purposes: (1) it reduces the overall weight of the crossarm structure, and (2) it allows air to more readily pass by (and through) the crossarm 410 without exerting a large force due to wind pressure. It will be understood that the number of openings and the particular arrangement and shapes of these openings in the left and right members 420, 430 could be significantly modified without departing from the principles of the present invention. If desired, openings or cut-outs could additionally be made in the horizontal portion 412 of the crossarm 410 without departing from the principles of the present invention.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. An antenna mast adapter, comprising:

an elongated crossarm member having a first distal end and a second distal end, and a mast mounting portion therebetween, said first distal end having a first antenna mounting portion that provides a first area for mounting a first unitary antenna, said second distal end having a second antenna mounting portion that provides a second area for mounting a second unitary antenna; and said mast mounting portion being disposed to mount said crossarm member to a mast in a substantially transverse orientation;

wherein said first and second unitary antennas are not substantially obstructed by said crossarm member in a plane that runs substantially between said first and second unitary antennas.

2. The antenna mast adapter as recited in claim 1, wherein said first antenna mounting portion and said second antenna mounting portion each comprises a substantially planar plate structure that is disposed to receive a base portion of one of said first or second unitary antenna.

3. The antenna mast adapter as recited in claim 2, wherein said substantially planar plate structure includes mounting holes for use with fasteners to mechanically mount one of said first or second unitary antenna thereto.

4. The antenna mast adapter as recited in claim 2, wherein said substantially planar plate structure exhibits: (a) a first mounting plate, (b) a second mounting plate, and (c) a support member therebetween; thereby facilitating the mounting of said first unitary antenna to said first mounting plate and the mounting of said second unitary antenna to said second mounting plate.

5. The antenna mast adapter as recited in claim 1, wherein said first unitary antenna points in a first direction, and said second unitary antenna points in a second direction that is opposite of said first direction.

6. The antenna mast adapter as recited in claim 1, further comprising: an individual waveguide for each of said first and second unitary antenna.

7. The antenna mast adapter as recited in claim 6, further comprising: a Y-adapter for a pair of said unitary antennas that connects to said individual waveguide of each of the unitary antennas of the pair.

8. An antenna mast adapter, comprising:

an elongated crossarm member having a first distal end and a second distal end, and a mast mounting portion therebetween, said first distal end having a first antenna mounting portion that provides a first area for mounting at least one unitary antenna, said second distal end having a second antenna mounting portion that provides a second area for mounting at least one unitary antenna; and said mast mounting portion being disposed to mount said crossarm member to a mast in a substantially transverse orientation, wherein said first antenna mounting portion and said second antenna mounting portion each comprises a substantially planar plate structure that is disposed to receive a base portion of a unitary antenna, and wherein said substantially planar plate structure is made of a magnetic material so as to facilitate mounting of said unitary antenna having a magnetic base structure.

9. An antenna mast adapter, comprising:

an elongated crossarm member having a first distal end and a second distal end, and a mast mounting portion therebetween, said first distal end having a first antenna mounting portion that provides a first area for mounting at least one unitary antenna, said second distal end having a second antenna mounting portion that provides a second area for mounting at least one unitary antenna; and said mast mounting portion being disposed to mount said crossarm member to a mast in a substantially transverse orientation, wherein said crossarm is constructed of substantially L-shaped material.

10. An antenna mast adapter, comprising:

an elongated crossarm member having a first distal end and a second distal end, and a mast mounting portion therebetween, said first distal end having a first antenna mounting portion that provides a first area for mounting at least one unitary antenna, said second distal end having a second antenna mounting portion that provides a second area for mounting at least one unitary antenna; and said mast mounting portion being disposed to mount said crossarm member to a mast in a substantially transverse orientation, wherein said crossarm is constructed of substantially planar material.

11. An antenna mast adapter, comprising:

an elongated crossarm member having a first distal end and a second distal end, and a mast mounting portion therebetween, said first distal end having a first antenna mounting portion that provides a first area for mounting at least one unitary antenna, said second distal end having a second antenna mounting portion that provides a second area for mounting at least one unitary antenna; and said mast mounting portion being disposed to mount said crossarm member to a mast in a substantially transverse orientation, wherein said crossarm exhibits a plurality of openings to reduce wind resistance.

12. An antenna mast adapter, comprising:

an elongated substantially horizontal crossarm member having a first end and a second end, and a mast mounting portion therebetween, said first end having a first antenna mounting portion that provides a first area for mounting at least one unitary antenna, said second end having a second antenna mounting portion that provides a second area for mounting at least one unitary antenna;

said mast mounting portion being disposed to mount said crossarm member to a vertical mast; and a plurality of separate waveguides that are in communication with each of said at least one unitary antenna at both said first end and said second end;

wherein said first antenna mounting portion and second antenna mounting portion are not substantially obstructed by said crossarm member in a plane that runs substantially between said first and second antenna mounting portions.

13. The antenna mast adapter as recited in claim 12, wherein said first antenna mounting portion and said second antenna mounting portion each comprises a substantially planar plate structure that is disposed to receive a base portion of a unitary antenna, wherein said plate structure includes mounting holes for use with fasteners to mechanically mount said unitary antenna thereto.

14. The antenna mast adapter as recited in claim 13, wherein said substantially planar plate structure exhibits a first planar surface on one side and a second planar surface on a second side, wherein a first unitary antenna pointed upward is mounted to said first planar surface, and a second unitary antenna pointed downward is mounted to said second planar surface, and wherein said first and second unitary antennas are substantially co-linear.

15. The antenna mast adapter as recited in claim 13, wherein said substantially planar plate structure exhibits: (a) a first mounting plate, (b) a second mounting plate, and (c) a support member therebetween; thereby facilitating the mounting of a first unitary antenna to said first mounting plate and the mounting of a second unitary antenna to said second mounting plate.

16. The antenna mast adapter as recited in claim 12, further comprising: a Y-adapter for a pair of unitary antennas that connects to said individual waveguide of each of the unitary antennas of the pair.

17. The antenna mast adapter as recited in claim 12, wherein said crossarm is constructed of substantially L-shaped material.

18. The antenna mast adapter as recited in claim 12, wherein said crossarm is constructed of substantially planar material.

19. The antenna mast adapter as recited in claim 18, wherein said crossarm exhibits a plurality of openings to reduce wind resistance.

20. The antenna mast adapter as recited in claim 12, wherein said first antenna mounting portion and said second antenna mounting portion each comprises a substantially planar plate structure that is disposed to receive a base portion of a unitary antenna, wherein said plate structure is constructed of a magnetic material so as to facilitate mounting of said unitary antenna having a magnetic base.

* * * * *